US008511977B2

(12) United States Patent
Hillier

(10) Patent No.: US 8,511,977 B2
(45) Date of Patent: Aug. 20, 2013

(54) HEAT TRANSFER PASSAGE

(75) Inventor: Steven Hillier, Manchester (GB)

(73) Assignee: Rolls-Royce PLC, London (GB)

( * ) Notice: Subject to any disclaimer, the term of this patent is extended or adjusted under 35 U.S.C. 154(b) by 534 days.

(21) Appl. No.: 12/824,519

(22) Filed: Jun. 28, 2010

(65) Prior Publication Data

US 2011/0008155 A1 Jan. 13, 2011

(30) Foreign Application Priority Data

Jul. 7, 2009 (GB) ..... 0911753.2

(51) Int. Cl.
*F01D 5/08* (2006.01)

(52) U.S. Cl.
USPC ..... 415/178; 416/96 R

(58) Field of Classification Search
USPC ..... 415/115, 116, 170.1, 191, 220; 416/95, 416/96 A, 96 R, 97 A, 97 R, 232
See application file for complete search history.

(56) References Cited

U.S. PATENT DOCUMENTS

| | | | | |
|---|---|---|---|---|
| 5,472,316 | A | 12/1995 | Taslim et al. | |
| 6,446,710 | B2 * | 9/2002 | Beeck et al. | 165/109.1 |
| 6,974,308 | B2 * | 12/2005 | Halfmann et al. | 416/97 R |
| 7,163,373 | B2 * | 1/2007 | Liang | 416/97 R |
| 2002/0005274 | A1 | 1/2002 | Beeck et al. | |
| 2002/0092644 | A1 | 7/2002 | Beutler et al. | |
| 2006/0171808 | A1 | 8/2006 | Liang | |

FOREIGN PATENT DOCUMENTS

| | | |
|---|---|---|
| EP | 0 945 595 A2 | 9/1999 |
| EP | 1 114 976 A2 | 7/2001 |
| EP | 1 775 420 A2 | 4/2007 |
| JP | A-62-126208 | 6/1987 |

OTHER PUBLICATIONS

Search Report issued in British Patent Application No. 0911753.2, on Oct. 27, 2009.
European Search Report dated Dec. 29, 2010 in corresponding European Patent Application No. 10167330.9.

* cited by examiner

*Primary Examiner* — Nathaniel Wiehe
*Assistant Examiner* — Woody A Lee, Jr.
(74) *Attorney, Agent, or Firm* — Oliff & Berridge, PLC

(57) ABSTRACT

This invention relates to heat transfer passage (102) within a component (100) and a component having such a heat transfer passage. The passage (102) comprises opposing side walls (112), a base (110) extending between said side walls and one or more upstanding formations (122) depending from said base between said side walls. The passage is arranged to receive a heat transfer fluid flow during use and the upstanding formation (122) is arranged to induce separation of a boundary layer portion of said heat transfer fluid flow from the base in use. The upstanding formation (122) comprises a projection portion (126) which is spaced from said opposing side walls (112). Such upstanding formations are typically referred to as turbulators.

14 Claims, 2 Drawing Sheets

HEAT TRANSFER PASSAGE

The present invention relates to heat transfer passages and more particularly, although not exclusively, to a heat transfer passageway provided within a cast component.

The control of heat transfer to and from a component is critical for numerous different types of equipment. This is often the case in equipment, for which combustion is an integral function of the equipment, as is the case for a number of types of engine. Gas turbine engines represent a particular example in which operating temperatures are so high that component damage or failure can occur if inadequate cooling is provided.

For such components, internal cooling passageways are provided, through which a cooling fluid, such as air, passes. Such cooling arrangements can allow components to be used effectively in environments in which the operating temperature exceeds the melting point of the component material.

It is known that a turbulent coolant flow allows for increased heat transfer between the component and the coolant. To this end it has been proposed to introduce formations within cooling passageways in order to cause separation of the coolant boundary layer flow from the wall of the passageway and thereby induce a chaotic, turbulent flow. Such formations are often referred to as 'turbulators'.

A problem exists in that the formations are integrally formed with the component itself. The preferred method of manufacture for a number of gas turbine engine components which have internal cooling passageways is investment casting (often referred to as 'lost-wax casting'). In such a process, a negative of the final component is required, using which the actual component itself is cast. Internal features of the final component are produced using a core within the mould.

Projecting formations, such as turbulators, in the final component are represented by indentations or cut-outs into the negative or core and can significantly reduce structural stability. Such parts can be inherently difficult to handle and problems associated therewith can reduce component yield.

For the above reasons at least, it is conventionally understood that turbulator geometry and arrangement must be kept below certain constraints. However the inventor has determined that only a partial potential benefit of the turbulators is realised within such conventional constraints.

In view of the above problems, it is an aim of the present invention to provide a heat transfer passageway for which heat transfer is promoted but which does not significantly hamper manufacture.

According to the present invention there is provided a heat transfer passage within a component, said passage comprising opposing side walls, a base extending between said side walls and one or more upstanding formations depending from said base between said side walls, the passage arranged to receive a heat transfer fluid flow during use, wherein the upstanding formation is arranged to induce separation of a boundary layer portion of said heat transfer fluid flow from the base in use and comprises a projection portion which is spaced from said opposing side walls.

According to one embodiment, the projection is shaped such that the majority of the cooling flow passes over the projection portion rather than through the space between the projection portion and the side wall. The upstanding formation typically extends only part way into the cooling passage from the base.

The passage may comprise a further wall, which opposes the base. Accordingly, the passage may be substantially enclosed.

The passage may be elongate in form. The base may be located towards a gas washed surface which has an elevated temperature during operation and from which heat is intended to be transferred by coolant flowing along the heat transfer passage.

Preferably, the upstanding formation comprises a first portion which contacts both the opposing side walls and the base, and the projection portion depends there-from and is spaced from the base by the first portion. The first portion typically extends only part way—typically less than half way—up the height of the cooling passage from the base. The combined first and projection portions may extend only part way—typically less than half way—up the height of the cooling passage from the base.

In one embodiment, the projection portion has a width dimension which is smaller than the width of the passage but which is sufficiently large such that the majority of the flow through the passage passes over the projection portion rather than through the space between the projection portion and either or both side walls. The projection portion may be spaced from either or both side walls. The projection portion may span at least 50% of the passage width.

In one embodiment, the projection portion accounts for at least 30% of the total depth of the upstanding formation from the base surface.

The upstanding formation including the projection portion may be obliquely angled relative to any or any combination of the base and/or side walls. The upstanding formation may be obliquely angled in either or both of two senses relative to the base and/or side walls. The upstanding formation may be substantially perpendicular to either or both of the base and/or side walls.

According to one embodiment, the passage comprises a plurality of upstanding formations spaced along its length.

The passage may comprise a further wall opposing the base. The base and walls may define a cooling passage which is substantially enclosed. The further wall may comprise one or more inlet and/or outlet openings therein to allow for the flow of coolant along the passage.

In one embodiment, the passage base, side walls and upstanding formations are integrally formed of a substantially homogenous material.

According to one embodiment, the upstanding formation may comprise a plurality of projection portions, the plurality of projections being shaped such that the majority of the cooling flow passes over the projection portions rather than through the space between the outermost projection portions and the side wall. The projection portions may for example take the form of castellations.

According to a further aspect of the present invention, there is provided a gas turbine engine component comprising one or more heat transfer passages according to the first aspect.

The component may be formed by investment casting and may comprise any of the preferable features described in relation to the first aspect. The component may comprise a gas turbine engine component.

The term base is used herein with reference to the primary wall from which the upstanding formation depends. That may be considered to be the wall which the upstanding formation traverses in its entirety. The term 'base' is not intended to be construed as limited to any particular wall orientation relative to the horizontal or vertical plane.

One or more working embodiments of the present invention are described in further detail below by way of example with reference to the accompanying drawings, of which:

Figure 1:
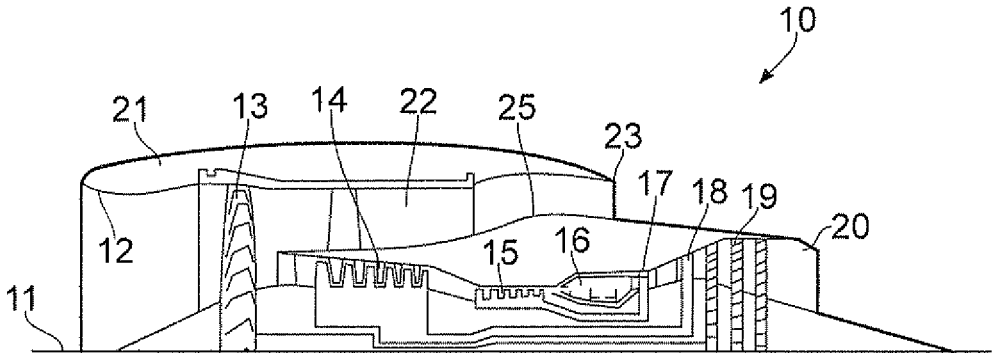
FIG. 1 shows an upper half of a longitudinal section through a gas turbine engine.

With reference to FIG. 1, a ducted fan gas turbine engine generally indicated at 10 has a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, and intermediate pressure turbine 18, a low-pressure turbine 19 and a core engine exhaust nozzle 20. A nacelle 21 generally surrounds the engine 10 and defines the intake 12, a bypass duct 22 and a bypass exhaust nozzle 23.

The gas turbine engine 10 works in a conventional manner so that air entering the intake 11 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high, intermediate and low-pressure turbines 17, 18, 19 respectively drive the high and intermediate pressure compressors 15, 14 and the fan 13 by suitable interconnecting shafts.

Alternative gas turbine engines may have two rather than three shaft configuration such that the function of the intermediate and high pressure compressors is combined on a single spool. Other gas turbine engines may have greater or lesser bypass flow ratios, may substitute the ducted fan 13 for an unducted propeller or else may avoid a bypass altogether such that all compressed air passes through the combustion equipment 16.

The cooling passage of the present invention may be applied in particular to components in the vicinity of the combustor, the high pressure and low pressure turbines. Such components may comprise nozzle guide vanes, casing and seal segments and high pressure or intermediate pressure turbine blades. This list is not exhaustive and the present invention may be applicable to any components which have internal cooling passages through which a coolant is intended to flow during operation. Typically such cooling passages are used to cool hot gas washed surfaces or walls.

Figure 2:
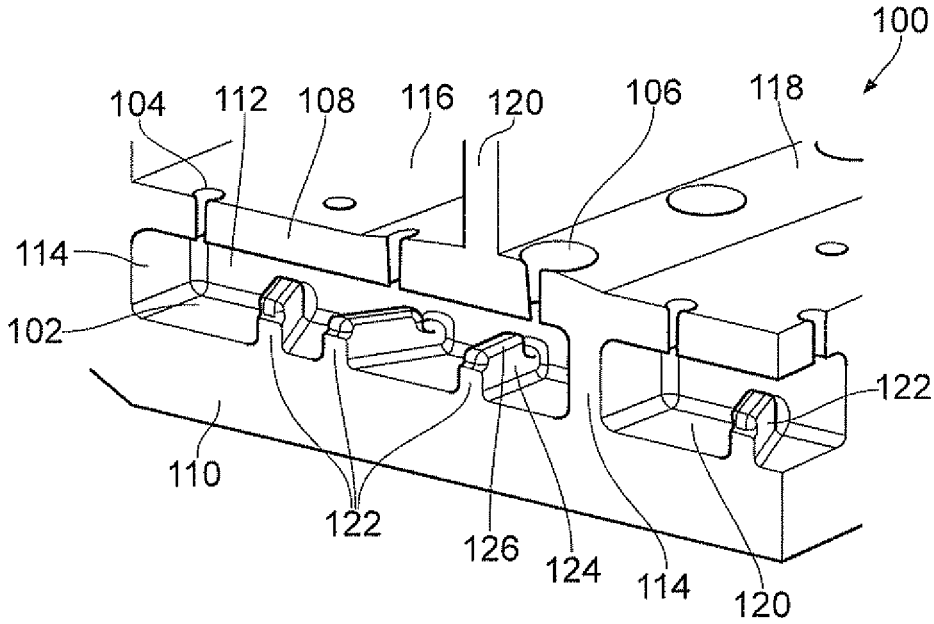
FIG. 2 shows a cut-away three-dimensional view of a heat transfer passage according to the present invention.

Turning now to FIG. 2 there is shown a specific embodiment of the present invention applied to an intermediate pressure seal segment 100. A number of such seal segment components are located about the intermediate turbine 18 so as to minimise clearance with the turbine and avoid parasitic flow losses about the turbine.

The component 100 comprises at least one cooling passage 102 having one or more inlets 104 and at least one outlet 106. The inlet and outlet openings are formed in a passage wall 108 which is located furthest from the wall 110 to be cooled. The wall to be cooled 110 is herein referred to as a base although it will be appreciated that the component may be oriented in any manner such that the base may or may not lowermost. In this example, the base 110 is closest to the gas washed surface to be cooled (i.e. facing the axis 11 or engine core interior gas path).

A plurality of inlets 104 are provided such that the cooling air entering the passage 102 impacts on the base 110 at a plurality of locations. The outlet 106 is of greater diameter than the inlets 104 such that the single outlet can accommodate the flow through multiple inlets.

The passage 102 is elongate in form having a pair of opposing side walls 112 (only one of which is shown) and opposing end walls 114. The base 110, opposing wall 108, side walls 112 and end walls 114 define an enclosed cooling passage 102 which is substantially rectangular in form. The cooling passage 102 including base 110, opposing wall 108, side walls 112 and end walls 114 is typically a cast feature within a cast component as will be described in further detail below.

The inlet 104 communicates with an adjacent cavity or chamber 116 in the component interior which is in fluid communication with a pressurised source of fluid coolant, which, in this case, is air ducted from one of the engine compressors. The cavity 116 may feed a number of cooling passages 102 in the form of a manifold-type arrangement.

Outlet 106 communicates with a further chamber or cavity 118 which is separated from cavity 116 by wall 120. The further cavity 118 may also serve as a manifold arrangement which receives coolant from a plurality of cooling passages 102. The cavity 118 may also serve as a source of coolant to further cooling passages such that coolant passes through a plurality of cooling passages in a sequential arrangement prior to exiting the cooling system.

Within one or more passages 102 or 120, there are located upstanding formations in the form of turbulators 122. A series of three turbulators are provided along the cooling passage shown although fewer or greater numbers of turbulators may be provided in each passage dependent on geometric and cooling requirements.

Each turbulator 122 comprises a main wall portion 124 which extends completely across the passageway between opposing side walls 112 and which is upstanding such that it extends part way into the passage 102 from the base 110. Each turbulator may be likened to a baffle formation.

The turbulators 122 are cast features such that they are integrally formed with the cooling passage walls.

The inventor has determined that the height restriction placed on conventional turbulators do not in fact allow for optimal cooling efficiency. Furthermore the inventor has determined that the coolant flow through the cooling passages is in fact choked by the exit openings and so the flow area restriction caused by the turbulators is in fact of negligible detriment to the coolant flow. Accordingly the inventor has proposed to increase the height of the turbulators in a hitherto unprecedented manner.

Each turbulator 122 has a projection portion 126 which is upstanding from the main portion 124. The projection portion 126, unlike the main portion, does not extend entirely across the width of the passage 102 between opposing side walls 112. Instead the projection portion is of reduced width such it has opposing shoulder formations which define a clearance or gap between the projection portion 126 and the adjacent side walls.

The projection portion typically spans greater than 40% of the passage width and preferably spans greater than half of the passage width. The projection portion may span between 40% and 90% of the passage width, and, in this case, between 50 and 70%. Accordingly an end of the projection portion may be spaced from the side walls by anywhere between 5% and 30% of the passage width, preferably between 10% and 25% of the passage width.

The height of the projection portion above the main portion may be greater than or less than the height of the main portion 124 and may be between 50% and 150% of the main portion height. In preferred embodiments, the projection portion accounts for between 30% and 60% of the total height of the turbulator formation 122.

The main portion 124 and projection portion 126 are integrally formed by casting.

In alternative embodiments, a plurality of spaced projections may be provided in place of the single projection portion shown in FIGS. 2 and 4. The plurality of projections may be arranged in a castellated formation. In such an embodiment, the plurality of projections may together meet the geometrical limitations described above. Accordingly the outermost of an array of projections may be spaced from an adjacent side wall by anywhere between 5% and 30% of the passage width.

As shown in FIG. 2, various orientations of turbulator relative to the passage are used. The turbulators may be angled substantially perpendicular to the passage side walls or else may be oriented at an oblique angle to the side walls, typically at an angle between 25 and 90° to the side wall in a plan view. In this embodiment, a combination of orientations is provided such that a first turbulator extends laterally (substantially perpendicularly) across the passage, a second turbulator is angled obliquely to the side walls and a third turbulator is angled obliquely in an opposite sense. Pairs of opposingly angled turbulators may be positioned in an adjacent arrangement as shown in FIG. 2.

Figure 3:
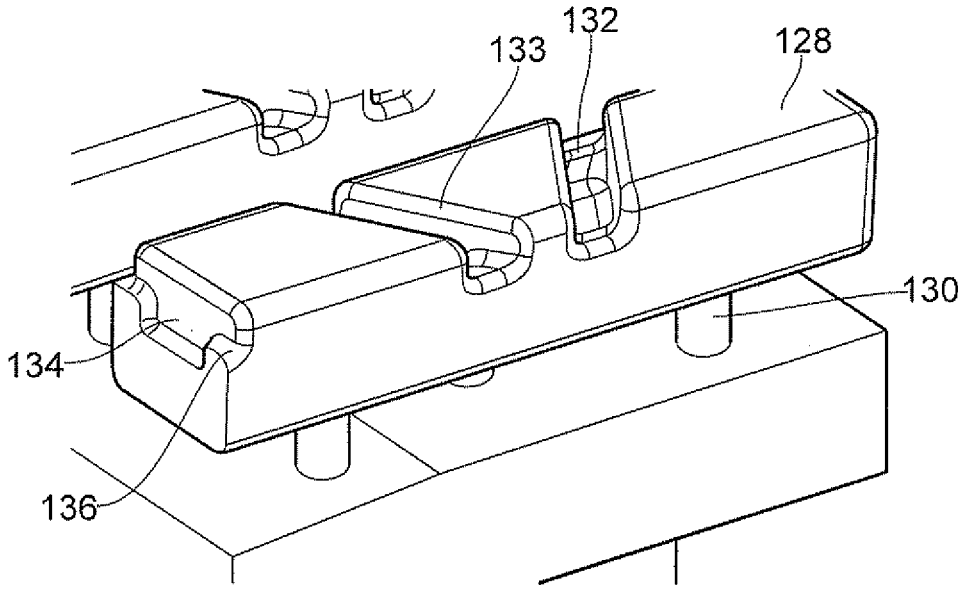
FIG. 3 shows a cut-away three-dimensional view of a core member used in the manufacture of the heat transfer passage of FIG. 2; and, FIGS. 4*a* to 4*c* show sectional and front views of three alternative projections according to the present invention.

Turning now to FIG. 3, there is shown a core member 128 used for formation of the passage 102. The core member 128 comprises a ceramic material and is formed in a conventional manner for investment casting as will be understood by a person skilled in the art. The core member forms a part of a larger core structure which comprises a number of linked core members such that a plurality of internal passages, cavities and/or other internal formations can be formed within the part to be cast.

Core features 130 which link the core members result in openings or passageways (e.g. openings 104 and 106 in FIG. 2), which may be subsequently blocked in the final part or else which may be retained in order to allow fluid communication between individual passages 102, 120 and/r chambers 116, 118.

The ceramic core member 128 takes the form of a body of ceramic material shaped according to the interior of the passage 102 in FIG. 2. The body has formed therein recesses 132, 133, 134 which correspond to the shape and position of the turbulators 122 in the cast component of FIG. 2. The body 128 and recesses therein is the negative of the passage 102 and integral turbulators 122.

The drawing of the core member 128 is cut away at a cross section through the recess 134 such that the internal geometry of the recesses can be seen. Each recess has a first depth towards its opposing edges and a second depth in its centre region. The second depth is greater than the first depth by a factor as described in relation to the turbulator geometry above.

Accordingly the structural rigidity of the core is retained to a large degree by the opposing shoulder formations 136 at the opposing sides of the core. This avoids the need for increased supporting structures 130 for the core member 128 which would increase the number of unwanted internal formations in the final cast part. The depth of the recesses towards their opposing edges can be tailored to match turbulator designs which have previously been tried and tested such that it does not result in a weakening of the core beyond that which has been hitherto tolerated.

The core is held within a mould (not shown) for the part 100 to be cast and the mould is filled with molten metal according to a conventional technique which is best suited for the part at hand. A number of filling or pouring options are available as will be understood by the skilled person and are not described here in detail for conciseness. Once the part is formed and solidified, the core is removed using standard techniques. Further treatment of the part may be required according to its intended use.

In use, a fluid coolant, in this case air, is fed under pressure into the cooling passage from the adjacent cavity via the one or more inlet openings. The flow rate and orientation of the coolant flow upon entry to the passage result in a relatively chaotic flow regime. However the global flow direction is along the length of the cooling passage 102 toward the exit aperture at the opposing end thereof.

As the coolant passes along the passage 102, it passes over each turbulator 122 in turn. The steep gradient of the rear face of each turbulator relative to the global flow direction causes separation of the flow boundary layer from the turbulator and hence the base 110 of the passage 102. The shedding of the boundary layer in this manner induces a vertical or rotational component to the flow, which further induces turbulent flow behaviour and increases the heat transfer between the coolant and the hot base and/or other walls of the passage.

The geometry of shoulder formations and the space formed between the projection portion 126 and the sides of the passage is such that the significant majority of the flow passes over the upper edge of the turbulator. A small portion of the flow passes between the edges of the projection portion 126 and the side walls 112 of the passage, which does not significantly reduce heat transfer. In fact, the shape of the shoulder formations may increase heat transfer by edge cooling and also by inducing boundary layer shedding in a perpendicular orientation to the shedding over the upper edge of the projection portion 126. This may beneficially add to the chaotic nature of the flow and heat transfer caused thereby, although such effects are difficult to quantify accurately.

Whilst a the embodiment above comprises a ceramic core, it will be appreciate that other materials may be used for the core dependent on the part to be manufactured and the level of intricacy and tolerance required for the features to be formed therein. Once such option may include a soluble wax core.

Figure 4A:
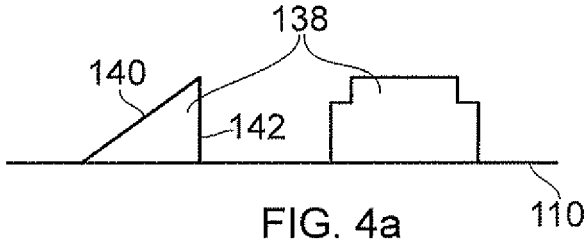
Figure 4B:
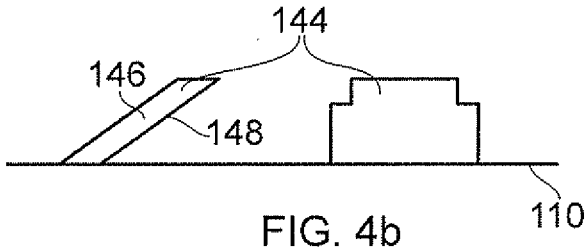
Figure 4C:
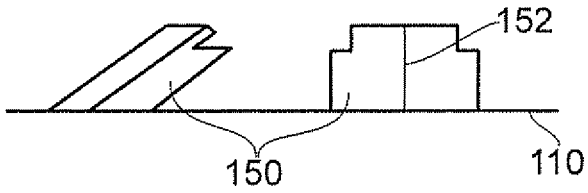

Turning now to FIGS. 4A to 4C, there are shown in section and plan a number of variations to the shape of the turbulators 122 which may be used to similar or increased heat transfer effect. In FIG. 4A, the turbulator 138 has a leading edge 140 which is obliquely angled to the passage base 110 so as to form a ramp. This increases the available surface area for heat transfer over the turbulator. The downstream face 142 of the turbulator is substantially perpendicular to the base 110 as in the design described above.

In FIG. 4B, the turbulator 144 has a ramped leading edge 146 (similar to that of FIG. 4A) and a correspondingly angled downstream edge 148. Thus the entire turbulator s obliquely angled to the base 110, forming an overhang or recess behind the turbulator in which coolant may recirculate.

In FIG. 4C, the turbulator is obliquely angled with respect to both the base and the side walls of the passage. In this particular embodiment, the turbulator is doubly angled about its centre 152 such that it appears chevron-shaped in plan. This further increases the available surface area of the turbulator for heat transfer with the coolant flow.

The invention claimed is:

1. A heat transfer passage within a component, said passage being arranged to receive a heat transfer fluid flow during use and comprising:

opposing side walls, a base extending between said side walls and one or more upstanding formations extending from said base between said side walls, each of the one or more upstanding formations including a projection portion which is spaced from at least one of said opposing walls, wherein the one or more upstanding formations are arranged to induce separation of a boundary layer portion of said heat transfer fluid flow from the base in use, each of the one or more upstanding formations includes a first portion which contacts both the opposing side walls and the base, the projection portion, which is spaced from at least one of said opposing walls, extends from each of the one or more upstanding formations and is spaced from the base by the first portion, and the projection portion spans at least 60% of a width of the passage.

2. A heat transfer passage according to claim 1, wherein a width of the projection portion is smaller than the width of the passage but spans more than 60% of the width of the passage and is configured such that the majority of the flow through the passage passes over the projection portion rather than through the space between the projection portion and either or both side walls.

3. A heat transfer passage according to claim 1, wherein the projection portion is spaced from both side walls.

4. A heat transfer passage according to claim 1, wherein the projection portion accounts for at least 30% of the total depth of the upstanding formation from the base surface.

5. A heat transfer passage according to claim 1, wherein the upstanding formation is obliquely angled relative to any or any combination of the base and/or side walls.

6. A heat transfer passage according to claim 1 comprising a plurality of upstanding formations spaced along its length.

7. A heat transfer passage according to claim 1, wherein the passage comprises a further wall opposing the base such that the cooling passage is enclosed, the further wall having one or more inlet and/or outlet openings therein to allow for the flow of coolant along the passage.

8. A heat transfer passage according to claim 1, wherein the passage base, side walls and upstanding formations are integrally formed of a substantially homogenous material.

9. A heat transfer passage according to claim 1, wherein the upstanding formation protrudes only part-way into the cooling passage from the base.

10. A component comprising one or more heat transfer passages according to claim 1.

11. A component according to claim 10, which is formed by casting.

12. A component according to claim 10, which is formed by investment casting.

13. A component according to claim 10, being any one of a nozzle guide vane, a casing or seal segment or a turbine blade for a gas turbine engine.

14. A heat transfer passage according to claim 10, wherein a width of the projection portion is smaller than the width of the passage but spans more than 60% of the width of the passage and is configured such that the majority of the flow through the passage passes over the projection portion rather than through the space between the projection portion and either or both side walls.

* * * * *